US007537527B2

(12) United States Patent
Yamamoto

(10) Patent No.: US 7,537,527 B2
(45) Date of Patent: May 26, 2009

(54) GOLF CLUB HEAD AND GOLF CLUB USING THE SAME

(75) Inventor: Akio Yamamoto, Kobe (JP)

(73) Assignee: SRI Sports Limited, Kobe-Shi (JP)

( * ) Notice: Subject to any disclaimer, the term of this patent is extended or adjusted under 35 U.S.C. 154(b) by 432 days.

(21) Appl. No.: 11/418,243

(22) Filed: May 5, 2006

(65) Prior Publication Data

US 2006/0281581 A1 Dec. 14, 2006

(30) Foreign Application Priority Data

Jun. 8, 2005 (JP) ..... 2005-168384

(51) Int. Cl.
*A63B 53/04* (2006.01)

(52) U.S. Cl. ..... 473/324; 473/344; 473/345; 473/349

(58) Field of Classification Search ..... 473/324–350
See application file for complete search history.

(56) References Cited

U.S. PATENT DOCUMENTS 5,288,079 A * 2/1994 Katayama ..... 473/328
5,460,376 A * 10/1995 Schmidt et al. ..... 473/328
5,735,754 A * 4/1998 Antonious ..... 473/328
6,676,535 B2 * 1/2004 Sheets et al. ..... 473/328
6,758,763 B2 * 7/2004 Murphy et al. ..... 473/342
2008/0051218 A1 * 2/2008 Rae et al. ..... 473/349

FOREIGN PATENT DOCUMENTS

JP 7-313636 A 12/1995
JP 2003-093559 A 4/2003

* cited by examiner

*Primary Examiner*—Sebastiano Passaniti
(74) *Attorney, Agent, or Firm*—Birch, Stewart, Kolasch & Birch, LLP

(57) ABSTRACT

Vertical planes equally dividing space between a position of the shaft-hole axis of a head to a rearmost point of the head are defined as first vertical plane S1 to fifth vertical plane S5 starting from a face side. In a view showing a second contour R2 and a fourth contour R4 in overlapping relation, the second contour is defined by an intersection of the second vertical plane S2 and a head outside surface, and the fourth contour is defined by an intersection of the fourth vertical plane and the head outside surface. In this overlap view, toe-1 point t1 to toe-8 point t8are defined on a toe-side line portion of the second contour R2. Toe-side gaps T1 to T8 between the second contour R2 and the fourth contour R4 with respect to the respective points t1 to t8 are defined according to predetermined specifications.

6 Claims, 9 Drawing Sheets

TOE-HEEL DISTANCE BETWEEN
HEEL-SIDE CONTOURS (mm)

GOLF CLUB HEAD AND GOLF CLUB USING THE SAME

BACKGROUND OF THE INVENTION

The present invention relates to a golf club head and a golf club using the same.

An impact sound of the golf club head has been conventionally regarded as an important factor. Particularly, the quality of the impact sound is quite important for a golf club head including a hollow portion therein and a golf club head possessing a thin portion because these golf club heads are apt to produce a relatively great impact sound. The current trend is to reduce the thicknesses of individual parts of the head which is becoming larger and larger. Such a head tends to produce a low, loud impact sound, the tone quality of which is unpopular among many golfers.

In this connection, techniques for improving the impact sound have been disclosed. Specifically, Japanese Unexamined Patent Publication No. 93559/2003discloses a golf club head which is increased volume relative to the weight thereof by providing ribs on an inside surface of a sole, the ribs extending in a direction perpendicular to a face surface, thereby providing a good hit feeling and a comfortable impact sound at club-on-ball impact. Furthermore, Japanese Unexamined Patent Publication No. 313636/1995 proposes a technique pertaining to the sole provided with the rib, although the technique is not directed to the improvement of the impact sound. Disclosed in this patent publication is a hollow golf club head wherein a ridge is provided on an outside surface of the sole as extended perpendicularly to the face surface, the ridge contributing to the implementation of a low centroid design and facilitating swing through.

In terms of the volume and tone quality of the impact sound, the above golf club heads of the prior art are not fully improved. The vibrations of the sole upon impact with a ball are particularly great at an area near the face (an area adjacent to the face surface striking the ball). In the golf club heads of the above patent publications, the rib on the sole is extended from place near the face surface toward a back side of the head along a face-back direction. Therefore, the rib excessively suppresses the vibrations of the sole at the area near the face surface, so that the impact sound is excessively decreased in volume.

The above golf club heads of the prior art have another problem that the head tends to suffer decreased restitution performance because the portion near the face is excessively increased in rigidity because of the rib disposed adjacent to the face. An enhanced restitution performance for increasing carry distance may be achieved by decreasing the rigidity of the head. When decreased in the rigidity, however, the head will produce an impact sound excessively large in volume and low in tone pitch.

In a case where these ribs are not provided, on the other hand, the aforementioned problem of the impact sound having the excessively large volume or low tone pitch is likely to occur.

SUMMARY OF THE INVENTION

In view of the foregoing, the present invention has been accomplished and has an object to provide a golf club head adapted to produce an impact sound having a suitable volume and tone quality and to offer good carry distance performance.

A golf club head according to one aspect of the present invention has a definition that in an overlap view which projects a fourth contour on a second vertical plane thereby showing, on the second vertical plane, the fourth contour overlapped on a second contour, provided that the head is placed on a horizontal plane at a predetermined loft angle and lie angle as presenting a shaft-hole axis thereof in a first vertical plane perpendicular to the horizontal plane; that a plane which includes a rearmost point located on an outside surface of the head at place farthest away from the first vertical plane toward a back side of the head and which is in parallel to the first vertical plane is defined as a fifth vertical plane; that three planes parallel to the first vertical plane and equally dividing space between the first vertical plane and the fifth vertical plane into quarters are defined as the second vertical plane, a third vertical plane and a fourth vertical plane in this order starting from the first vertical plane; and that respective intersections of the second vertical plane and the head outside surface and of the fourth vertical plane and the head outside surface are defined as the second contour and the fourth contour, provided that a toe-most point on the fourth contour is defined as a toe-1 point whereas a sole-most point on the fourth contour is defined as a sole-lowest point; that seven points equally dividing a toe-side line portion of the fourth contour, extending from the toe-1 point to the sole-lowest point, into eight line segments with respect to a top-sole direction are defined as toe-2 point, toe-3 point, . . . and toe-8 point in this order starting from the toe-1 point; and that a toe-heel distance from the toe-1 point to a toe-side line portion of the second contour is defined as T1, a toe-heel distance from the toe-2 point to the toe-side line portion of the second contour is defined as T2, and similarly defined as T3, T4, . . . T8; any one of T5, T6 and T7 is the greatest of the distances T1 to T8, and has a definition that in a graph plotting eight coordinate values of the toe-1 point to the toe-8 point (0, T1), ($\alpha$, T2), . . . (7$\alpha$, T8) ($\alpha$ represents a positive constant) on orthogonal coordinates having top-sole distance (mm) from the toe-1 point on the abscissa and the toe-heel distance (mm) on the ordinate, an ordinate-axis distance between a straight line connecting the plot (0, T1) of the toe-1 point and the plot (7$\alpha$, T8) of the toe-8 point, and a plot defining the greatest toe-heel distance is in the range of 4 mm or more and 10 mm or less.

A golf club head according to another aspect of the invention has a definition that that in an overlap view which projects a fourth contour on a second vertical plane thereby showing, on the second vertical plane, the fourth contour overlapped on a second contour, provided that the head is placed on a horizontal plane at a predetermined loft angle and lie angle as presenting a shaft-hole axis thereof in a first vertical plane perpendicular to the horizontal plane; that a plane which includes a rearmost point located on an outside surface of the head at place farthest away from the first vertical plane toward a back side of the head and which is in parallel to the first vertical plane is defined as a fifth vertical plane; that three planes parallel to the first vertical plane and equally dividing space between the first vertical plane and the fifth vertical plane into quarters are defined as the second vertical plane, a third vertical plane and a fourth vertical plane in this order starting from the first vertical plane; and that respective intersections of the second vertical plane and the head outside surface and of the fourth vertical plane and the head outside surface are defined as the second contour and the fourth contour, provided that a heel-most point on the fourth contour is defined as a heel-1 point whereas a sole-most point on the fourth contour is defined as a sole-lowest point; that seven points equally dividing a heel-side line portion of the fourth contour, extending from the heel-1 point to the sole-lowest point, into eight line segments with respect to a top-sole direction are defined as heel-2 point, heel-3 point, . . . and heel-8 point in this order starting from the heel-1 point; and that a toe-heel distance from the heel-1 point to a heel-side line portion of the second contour is defined as H1, a toe-heel distance from the heel-2 point to the heel-side line portion of the second contour is defined as H2, and similarly defined as H3, H4, . . . H8; any one of H5, H6 and H7 is the greatest of the distances H1 to H8, and has a definition that in a graph plotting eight coordinate values of the heel-1 point to the heel-8 point (0, H1), (β, H2), . . . (7β, H8) (β represents a positive constant) on orthogonal coordinates having top-sole distance (mm) from the heel-1 point on the abscissa and the toe-heel distance (mm) on the ordinate, an ordinate-axis distance between a straight line connecting the plot (0, H1) of the heel-1 point and the plot (7β, H8) of the heel-8 point, and a plot defining the greatest toe-heel distance is in the range of 2 mm or more and 8 mm or less.

If the configuration of the golf club head is defined as described above, the sole, in particular, has a different configuration from that of the conventional golf club head. Specifically, the golf club head of the invention is configured such that a sole width at a back-side portion (hereinafter, also referred to as "sole rear portion"), as decreased from a sole width at a face-side portion (hereinafter, also referred to as "sole front portion"), is smaller than that of a conventional golf club head (hereinafter, also referred to as "configuration narrowing down the sole rear portion"). Because of the decreased sole width at the sole rear portion, the head is increased in the rigidity at the sole, so as to overcome the problem of the impact sound having the excessively large volume or low frequency. While the overall sole having the small width makes the head less easy to address because the head is not stabilized during address, the head of the present invention is easy to address because the sole front portion having the relatively great width serves to stabilize the head during address. If the sole width at the sole front portion is small, the sole front portion is increased in the rigidity so much that a heavy impact may be experienced at club-on-ball impact. However, the golf club head of the present invention has the relatively great sole width at the sole front portion and hence, the heavy impact at club-on-ball impact may be lessened. Furthermore, the head has the relatively great sole width at the sole front portion, thus overcoming the problem that the impact sound is excessively reduced in volume due to the excessively reduced vibrations of the sole.

The golf club head of the above constitution is not increased in the rigidity of the whole body thereof but is increased in the rigidity at the sole. Therefore, the sole has a higher rigidity than that of the crown, so that the crown is more prone to deformation than the sole. Accordingly, a face-upper portion is more likely to be deformed rearwardly (in a manner to increase a real loft angle of the face) than a face-lower portion. This leads an increased launch angle, which accordingly increases a carry distance.

In addition, the head is not excessively increased in the rigidity at the sole front portion, which has the relatively great width. Hence, a dent deformation of the face at impact with the ball is not excessively restricted. On this account, as well, the head tends to achieve an increased carry distance.

DETAILED DESCRIPTION

The embodiment of the present invention will hereinbelow be described with reference to the accompanying drawings.

Figure 1:
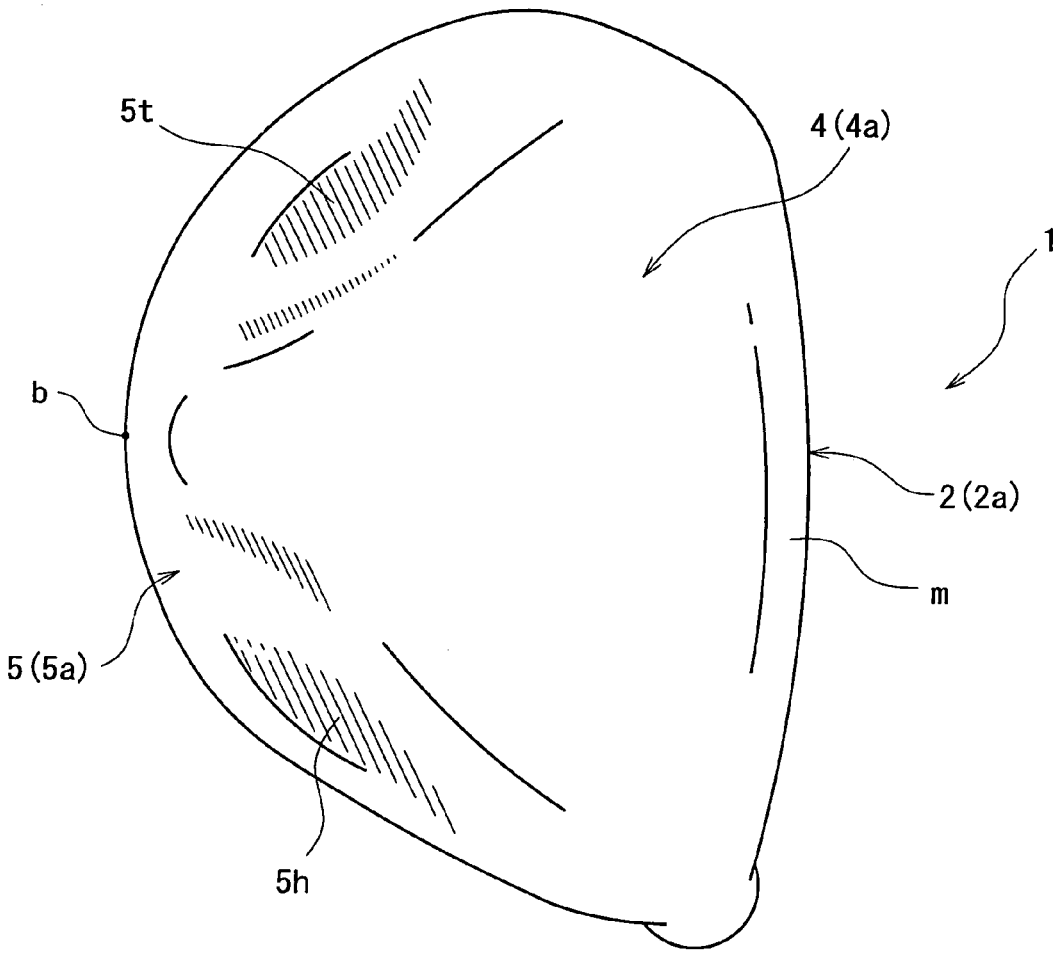
FIG. 1 is a bottom view of a golf club head according to one embodiment of the invention as viewed from a sole side.
Figure 2:
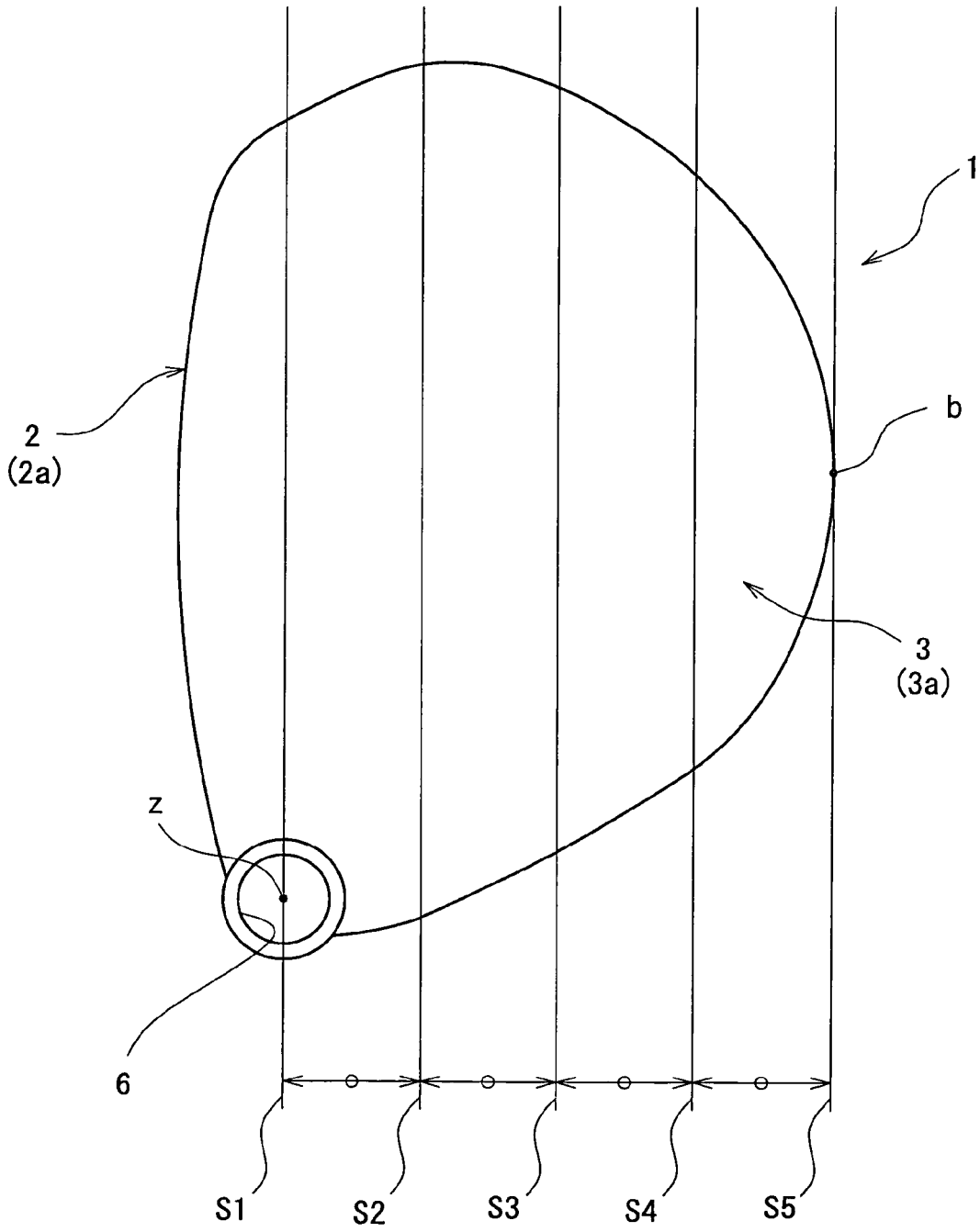
FIG. 2 is a plan view of the head of FIG. 1 as viewed from a crown side.
Figure 3:
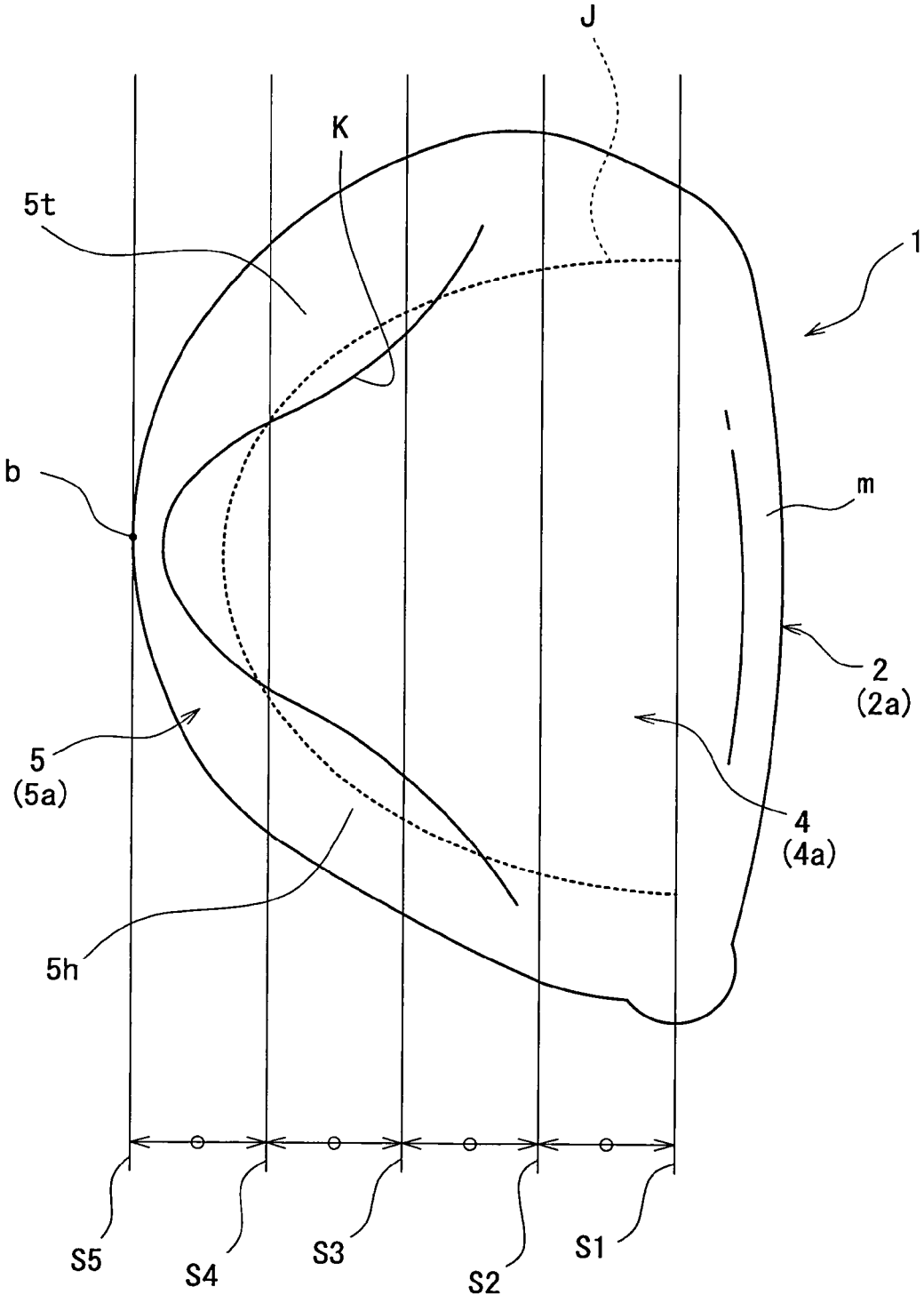
FIG. 3 is a diagram emphasizing a boundary between a sole and a side portion in the bottom view of FIG. 1 for clarity sake.

FIG. 1 and FIG. 3 depict a golf club head 1 according to one embodiment of the present invention (hereinafter, simply referred to as "head") as viewed from a sole side. FIG. 2 depicts the head 1 as viewed from a crown side. This head 1 is a golf club head of wood type. The head 1 has a hollow interior.

The head 1 includes: a face 2 having an outside surface defining a face surface 2*a* contacting a ball when striking the ball; a crown 3 constituting an upper face of the head as extending from an upper edge of the face 2 toward a head back side (head rear side); a sole 4 constituting a bottom surface (sole surface 4*a*) of the head as extending from a lower edge of the crown 3 toward the head back side; a side portion 5 extending between the crown 5 and the sole 4 as excluding the face 2; and a shaft hole 6 to which a shaft is insertedly bonded. The shaft hole 6 is located on a heel side of the head 1.

Examples of a material for forming the head 1 include pure titanium, titanium alloys (such as 6Al-4V titanium, 15V-3Cr-3Al-3Sn titanium, 15Mo-5Zr-3Al titanium, 13V-11Cr-3Al titanium), maraging steels, aluminum alloys, duralumin, CFRP (carbon fiber reinforced plastic) and the like. These materials may be used alone or in combination of plural types.

The face surface 2*a* defines a convexed surface incorporating a bulge of a predetermined curvature radius and a roll of a predetermined curvature radius. A crown surface 3*a* constituting an outside surface of the crown 3 is also defined by a convexed surface. The most part of the sole surface 4*a* is defined by a cylindrical convex surface which has a curvature with respect to a toe-heel direction but has no curvature with respect to a face-back direction. The provision of the toe-heel curvature leads to the reduction of a ground contact area of the head during duff shot, thus contributing to a reduced ground contact resistance. The face-back flat design is useful in stabilizing the head during address so as to make the head easy to address. The sole surface 4*a* is formed with a chamfer m of a predetermined width at an area adjoining the face 2. The chamfer m contributes to a reduced catch of a leading edge of the head (ground contact resistance by the leading edge) during duff shot.

The head 1 has distinctive configurations of the sole surface 4*a* and a side surface 5*a*. FIG. 3 clearly shows a boundary K between the side surface 5*a* and the sole surface 4*a* with a solid line, the side surface 5*a*defining an outside surface of the side 5. In FIG. 3, a boundary J between a side surface and a sole surface of a conventional head is also indicated by a broken line. As shown in the figure, the head 1 includes a toe-side recess St locally formed on a toe-side portion of the side 5, and a heel-side recess 5*h* locally formed on a heel-side portion of the side 5. The heel-side recess 5*h* and the toe-side recess St are located in the vicinity of a fourth vertical plane S4 of the five planes, first vertical plane S1 to fifth vertical plane S5 (details of which will be described hereinlater). These planes divide the head 1 into segments. As compared with that of the conventional head, the side surface 5*a* has a wider width at an area adjacent to the toe-side recess St. Likewise, the side surface 5*a* has a wider width at an area adjacent to the heel-side recess 5*h*, as compared with that of the conventional head (see FIG. 3).

According to the present invention, an overlap view is contemplated which shows a second contour R2 overlapped with a fourth contour R4, provided that the planes dividing space defined between a position of the axis of the shaft hole and a rearmost point b of the head 1 into quarters with respect to the face-back direction are defined as the first vertical plane S1 to the fifth vertical plane S5 in this order starting from the face side, and that the second contour R2 and the fourth contour R4 are defined by respective intersections of the second vertical plane S2 and the head outside surface and of the fourth vertical plane S4 and the head outside surface. The configuration of the head is specified based on this overlap view. Based on the overlap view, toe-1 point t1 to toe-8 point t8 are first defined on a toe-side line portion of the second contour R2, whereas heel-1 point h1 to heel-8 point are defined on a heel-side line portion of the second contour. Then, individual toe-side gaps T1 to T8 between the second contour R2 and the fourth contour R4 with respect to the respective points t1 to t8 are defined according to predetermined specifications, whereas individual heel-side gaps H1 to H8 between the second contour R2 and the fourth contour R4 with respect to the respective points h1 to h8 are defined according to predetermined specifications.

First, description is made on the first vertical plane S1 to the fifth vertical plane S5.

Let us consider a position where the head 1 is placed on the horizontal plane (not shown) at predetermined loft angle and lie angle as presenting a shaft-hole axis z (see FIG. 2) in the first vertical plane S1 perpendicular to the horizontal plane (hereinafter, also referred to as "reference position"). The loft angle may be a loft angle indicated on the head. The fifth vertical plane S5 is defined as a plane which includes the rearmost point b farthest away from the first vertical plane S1 toward the back side and which is in parallel to the first vertical plane S1.

Then, the three planes extending in parallel to the first vertical plane S1 and dividing the space between the first vertical plane S1 and the fifth vertical plane S5 into quarters are defined as the second vertical plane S2, the third vertical plane S3 and the fourth vertical plane S4 in this order starting from the first vertical plane S1. Accordingly, the first vertical plane S1, the second vertical plane S2, the third vertical plane S3, the fourth vertical plane S4 and the fifth vertical plane S5 are arranged with equal spacing and in parallel relation with one another.

Based on the first vertical plane S1 to the fifth vertical plane S5 so defined, the configuration of the head 1 is defined as follows.

Figure 4:
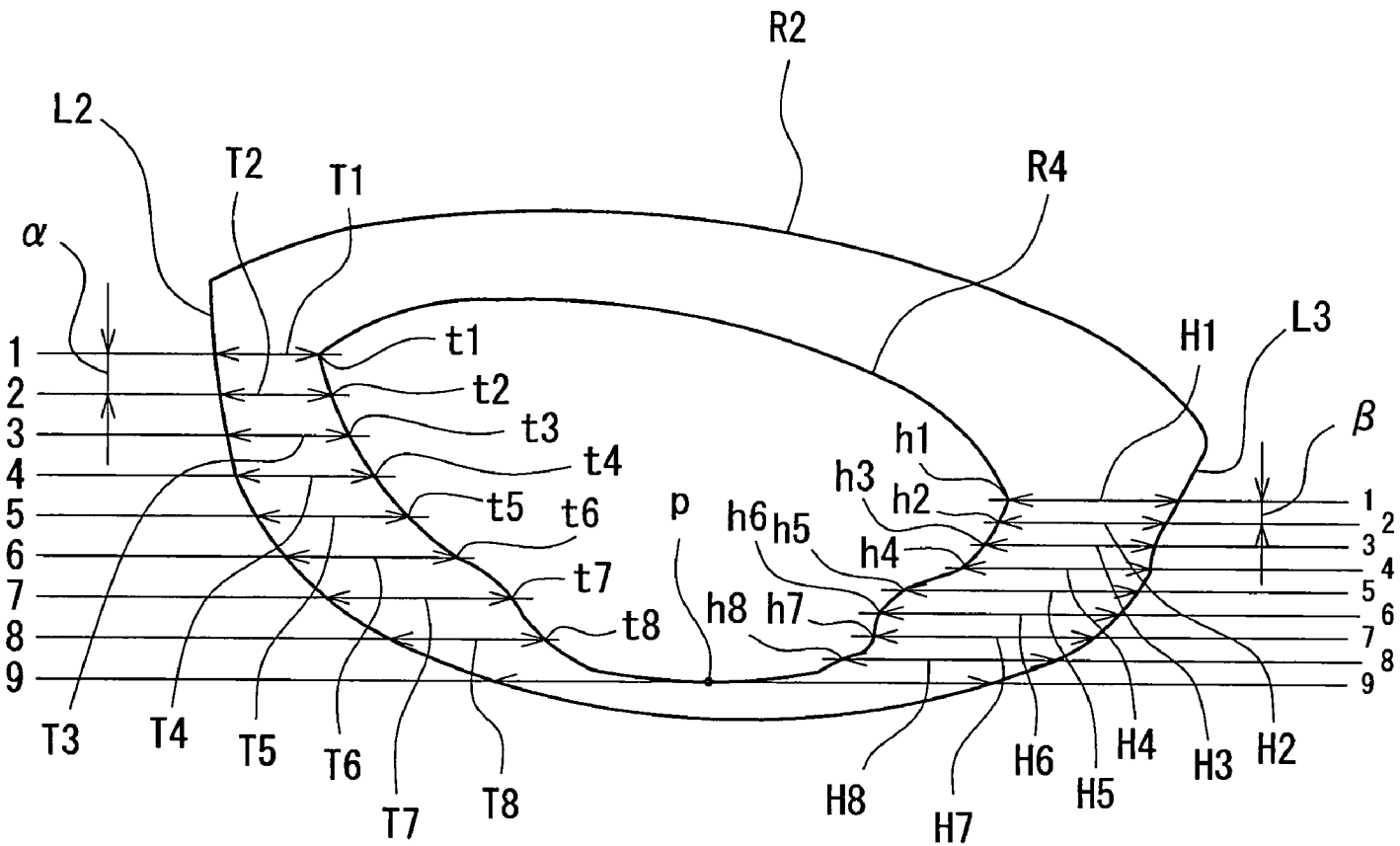
FIG. 4 is an overlap view of the embodiment shown in FIG. 1 and of Example 1.
Figure 5:
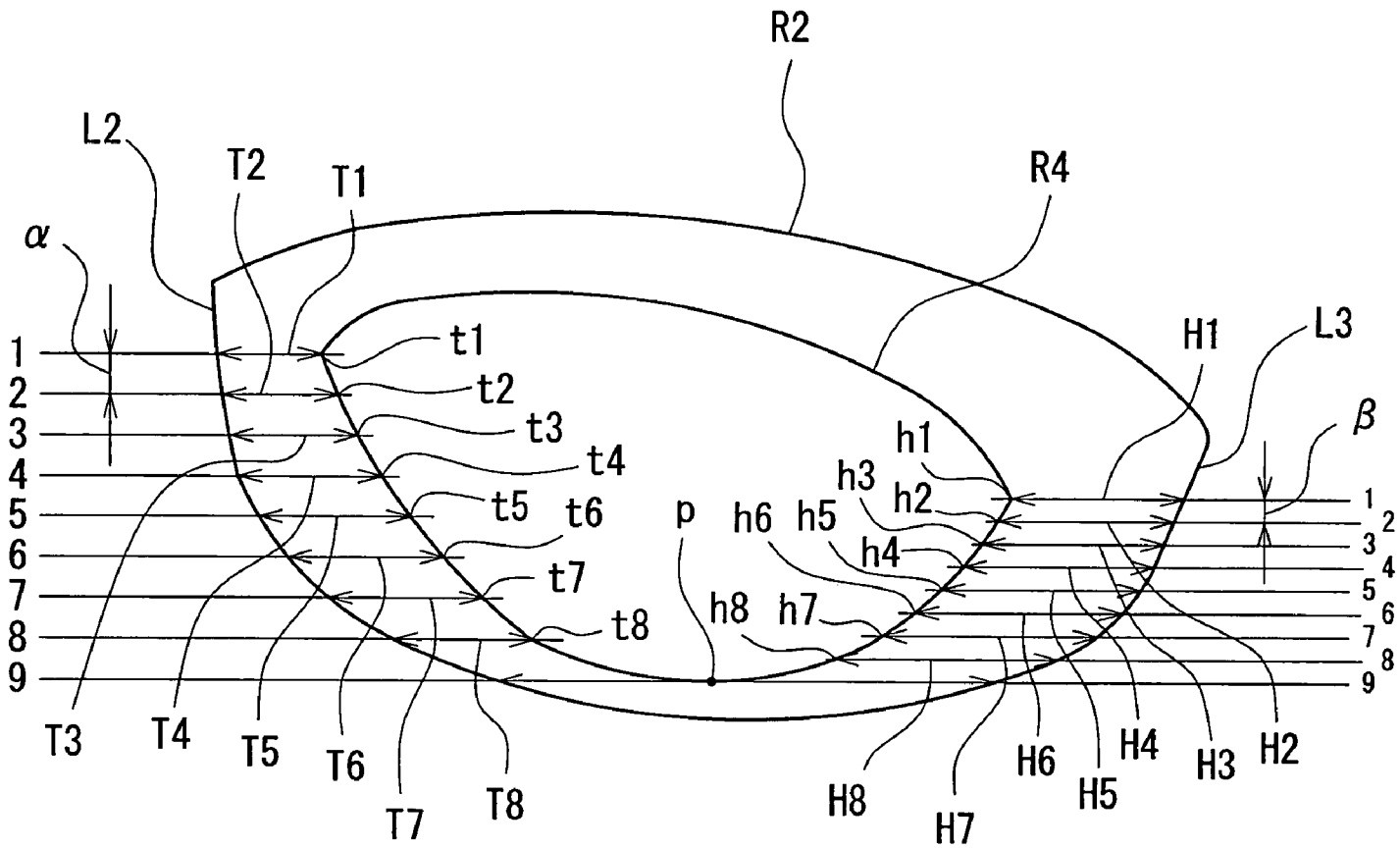
FIG. 5 is an overlap view of Comparative Example 1.

The respective intersections of the second vertical plane S2 and the head outside surface and of the fourth vertical plane S4 and the head outside surface are defined as the second contour R2 and the fourth contour R4. The fourth contour R4 is projected on the second vertical plane S2 so as to obtain an overlap view of FIG. 4 showing the fourth contour R4 overlapped on the second contour R2. In the overlap view (FIG. 4), a toe-most point on the fourth contour R4 is defined as the toe-1 point t1 whereas a sole-most point on the fourth contour R4 is defined as the sole-lowest point p. Seven points equally dividing a toe-side line portion of the fourth contour R4, extending from the toe-1 point t1 to the sole-lowest point p, into eight line segments with respect to a top-sole direction are defined as the toe-2 point t2, toe-3 point t3, toe-4 point t4, toe-5 point t5, toe-6 point t6, toe-7 point t7 and toe-8 point t8 in this order starting from the toe-1 point t1.

A toe-heel distance between the toe-1 point t1 and a toe-side line portion L2 of the second contour R2 is defined as T1, a toe-heel distance between the toe-2 point t2 and the toe-side line portion L2 is defined as T2, a toe-heel distance between the toe-3 point t3 and the toe-side line portion L2 is defined as T3, a toe-heel distance between the toe-4 point t4 and the toe-side line portion L2 is defined as T4, a toe-heel distance between the toe-5 point t5 and the toe-side line portion L2 is defined as T5, a toe-heel distance between the toe-6 point t6 and the toe-side line portion L2 is defined as T6, a toe-heel distance between the toe-7 point t7 and the toe-side line portion L2 is defined as T7, and a toe-heel distance between the toe-8 point t8 and the toe-side line portion L2 is defined as T8 (see FIG. 4).

In this case, the head 1 has such a configuration that any one of T5, T6 and T7 is the greatest of the aforesaid distances T1 to T8. At least any one of the distances T5, T6 and T7 is made relatively longer by forming the aforesaid toe-side recess St and the heel-side recess 5*h*.

Figure 6:
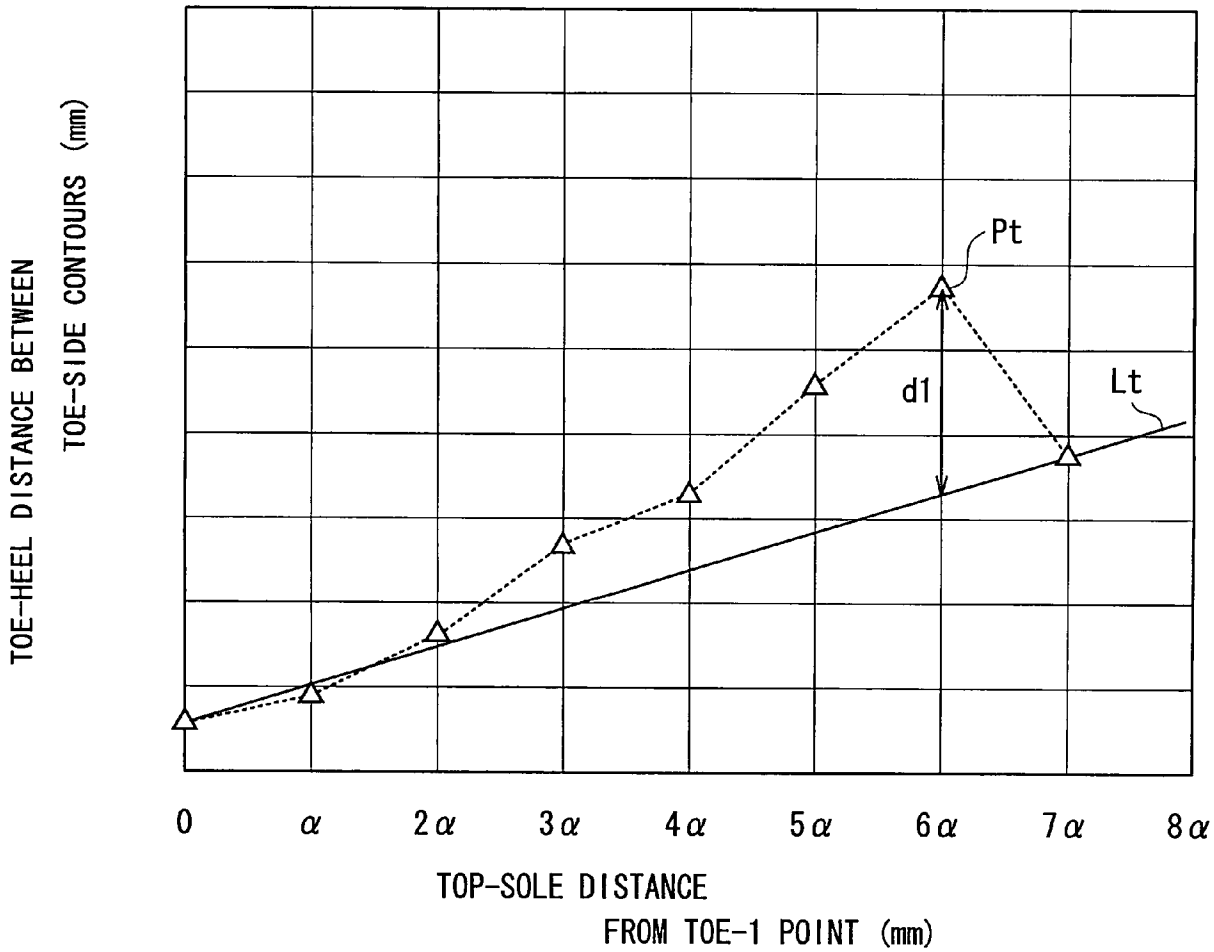
FIG. 6 shows an exemplary toe-side graph.

Then, a graph (hereinafter, also referred to as "toe-side graph") is prepared wherein the eight coordinate values of the toe-1 point to the toe-8 point (0, T1), ($\alpha$, T2), . . . ($7\alpha$, T8) ($\alpha$ represents a positive constant) are plotted on orthogonal coordinates having top-sole distance (mm) from the toe-1 point t1 on the abscissa and toe-heel distance (mm) represented by the above symbols T1 to T8 on the ordinate. This toe-side graph is shown in FIG. 6. In the graph, an ordinate-axis distance d1 between a straight line Lt (see FIG. 6) connecting the plot (0, T1) of the toe-1 point and the plot ($7\alpha$, T8) of the toe-8 point, and a plot Pt defining the greatest toe-heel distance is in the range of 4 mm or more and 10 mm or less.

The above symbol $\alpha$ represents an eighth part width obtained by equally dividing the toe-side line portion of the fourth contour R4, extending from the toe-1 point t1 to the sole-lowest point p, into eight segments with respect to the top-sole direction.

A heel-side configuration of the head is defined as follows. In the overlap view of FIG. 4, a heel-most point on the fourth contour R4 is defined as the heel-1 point h1 whereas the sole-most point on the fourth contour R4 is defined as the sole-lowest point p (mentioned supra). Seven points equally dividing a heel-side line portion of the fourth contour R4, extending from the heel-1 point h1 to the sole-lowest point p, into eight line segments with respect to the top-sole direction are defined as the heel-2 point h2, heel-3 point h3, heel-4 point h4, heel-5 point h5, heel-6 point h6, heel-7 point h7 and heel-8 point h8 in this order starting from the heel-1 point h1. Then, a toe-heel distance between the heel-1 point h1 and a heel-side line portion L3 of the second contour R2 is defined as H1, a toe-heel distance between the heel-2 point h2 and the toe-side line portion L3 is defined as H2, a toe-heel distance between the heel-3 point h3 and the heel-side line portion L3 is defined as H3, a toe-heel distance between the heel-4 point h4 and the heel-side line portion L3 is defined as H4, a toe-heel distance between the heel-5 point h5 and the heel-side line portion L3 is defined as H5, a toe-heel distance between the heel-6 point h6 and the heel-side line portion L3 is defined as H6, a toe-heel distance between the heel-7 point h7 and the heel-side line portion L3 is defined as H7, and a toe-heel distance between the heel-8 point h8 and the heel-side line portion L3 is defined as H8.

Figure 7:
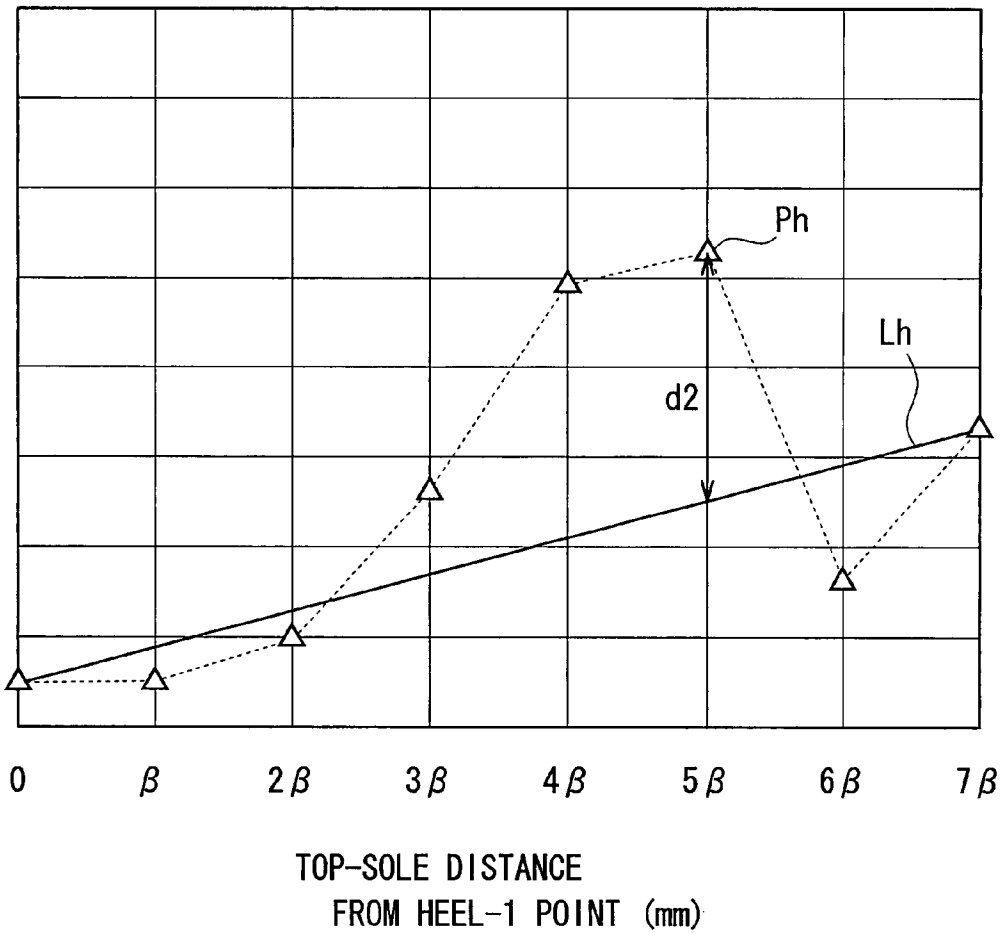
FIG. 7 shows an exemplary heel-side graph.

In this case, the head 1 has such a configuration that any one of H5, H6 and H7 is the greatest of the aforesaid distances H1 to H8. Then, a graph (hereinafter, also referred to as "heel-side graph") is prepared wherein the eight coordinate values of the heel-1 point to the heel-8 point (0, H1), (β, H2), . . . (7β, H8) (βrepresents a positive constant) are plotted on orthogonal coordinates having top-sole distance (mm) from the heel-1 point h1 on the abscissa and toe-heel distance (mm) represented by the above symbols H1 to H8 on the ordinate. This heel-side graph is shown in FIG. 7. In the graph, an ordinate-axis distance d2 between a straight line Lh connecting the plot (0, H1) of the heel-1 point and the plot (7β, H8) of the heel-8 point, and a plot Ph defining the greatest toe-heel distance is in the range of 2 mm or more and 8 mm or less.

The above symbol β represents an eighth part width obtained by equally dividing the heel-side line portion of the fourth contour R4, extending from the heel-1 point h1 to the sole-lowest point p, into eight segments with respect to the top-sole direction.

The aforesaid toe-heel direction means a direction of an intersection of the horizontal plane in the aforesaid reference position and each of the vertical planes (the first vertical plane S1 to the fifth vertical plane S5). The top-sole direction means a direction parallel to each of the vertical planes S1 to S5 and perpendicular to the toe-heel direction.

The head 1 having its sectional shapes defined as described above has a configuration narrowing down a sole rear portion. In this configuration, the sole is increased in the rigidity because of the relatively small sole width at the sole rear portion. Hence, the head is adapted to improve the impact sound having the excessively large volume or low frequency. If the overall sole has a small width, the head is less easy to address because the head is not stabilized during address. However, the head of the present invention has a relatively great sole width at a sole front portion, such as to be stabilized during address and to offer ease of address. Furthermore, the problem that the impact sound is excessively reduced in volume as a result of the excessively suppressed vibrations of the sole may be avoided by virtue of the relatively great sole width at the sole front portion. If the sole has a small width at the sole front portion, the rigidity of the sole front portion is increased so much that a heavy impact tends to be experienced at club-on-ball impact. However, the head of the present invention is adapted to prevent the excessive impact at club-on-ball impact by virtue of the relatively great sole width at the sole front portion.

The golf club head of the present invention is not increased in the rigidity of the whole body thereof but is increased in the rigidity at the sole. Therefore, the sole is prone to have a higher rigidity than that of the crown, so that the crown is comparatively more prone to deformation than the sole. When the face 2 is subjected to pressure upon impact with the ball, the face is prone to be deformed in a manner that a face-upper portion is displaced farther rearwardly (toward the back side) than a face-lower portion. That is, the pressure tends to cause such a deformation as to increase a real loft angle. This not only leads to an increased launch angle but also to an increased gear effect to reduce a quantity of back spin of the ball. Hence, the carry distance tends to increase.

In addition, the head is not excessively increased in the rigidity at the sole front portion, which has a relatively great width. Hence, a dent deformation of the face at impact with the ball is not excessively restricted. On this account, as well, the carry distance tends to increase.

The following are the reasons for limiting the aforesaid distance d1 to the range of 4 mm or more and 10 mm or less.

If the distance d1 is less than 4 mm, the sole rigidity is not fully increased so that the impact sound may be excessively increased in volume or may have an excessively low frequency. Therefore, the distance d1 may be preferably 4 mm or more, and more preferably 5 mm or more.

If the distance d1 exceeds 10 mm, the head has a configuration difficult to polish in a polishing step of a head manufacture process. This may lead to lowered productivity. Therefore, the distance d1 may be 10 mm or less, preferably 9 mm or less, more preferably 8 mm or less and even more preferably 6 mm or less.

The following are the reasons for limiting the aforesaid distance d2 to the range of 2 mm or more and 8 mm or less.

If the distance d2 is less than 2 mm, the sole rigidity is not fully increased so that the impact sound may be excessively increased in volume or may have an excessively low frequency. Therefore, the distance d2 may be 2 mm or more, preferably 2.5 mm or more, more preferably 3 mm or more, and even more preferably 4 mm or more.

If the distance d2 exceeds 8 mm, the head has a configuration difficult to polish in the polishing step of the head manufacture process. This may lead to lowered productivity. Therefore, the distance d2 may be 8 mm or less, preferably 7 mm or less, and more preferably 6 mm or less.

A head volume may be preferably 350 cc or more, more preferably 400 cc or more, and particularly preferably 430 cc or more. If the head volume is too small, the impact sound may become excessively decreased in volume. Furthermore, the head volume may be preferably 600 cc or less, more preferably 500 cc or less, and even more preferably 470 cc or less. If the head volume is too great, the impact sound may be excessively increased in volume or may have an excessively low frequency.

As to a head material, the whole body of the head may be formed from a metal. Otherwise, the head may partially include a non-metal member. In this case, a usable non-metal member may be exemplified by CFRP (carbon fiber reinforced plastic) and the like. It is noted however that the all-metal head and the head partially including the non-metal member may preferably have the sole formed from a metal. In the case where the sole is formed from a metal, the sole at impact with the ball is brought into greater vibrations than a sole formed from a non-metal material, so that a relatively large impact sound is produced from the metal sole. Hence, the sole formed from the metal has a higher need for the present invention and also attains an even higher effect of the present invention.

An area of the sole 4 may be preferably 55 $cm^2$ or more, more preferably 60 $cm^2$ or more, and even more preferably 65 $cm^2$ or more. If this area is too small, the vibrations of the sole are so small that an excessively small impact sound may result. Furthermore, the area of the sole may be preferably 85 $cm^2$ or less, more preferably 80 $cm^2$ or less, and even more preferably 75 $cm^2$ or less. If this area is too large, the sole is brought into excessively great vibrations, so that the impact sound may have excessively large volume and low tone pitch.

A mean thickness of the sole may be preferably 2.0 mm or less, more preferably 1.8 mm or less, and even more preferably 1.6 mm or less. If the mean thickness of the sole is too great, the impact sound may be too small in volume or may have an excessively high frequency.

Furthermore, the mean thickness of the sole may be preferably 1.0 mm or more, more preferably 1.1 mm or more, and even more preferably 1.2 mm or more. If the mean thickness of the sole is too small, the impact sound may be too large in volume or may have an excessively low frequency.

VERIFICATION OF THE EFFECT OF THE PRESENT INVENTION BASED ON EXAMPLES

Next, the effect of the present invention was verified by evaluating five types of golf clubs of Examples 1 to 3 according to the invention and of Comparative Examples 1 and 2.

Example 1

A head of Example 1 had a 2 pcs structure which was fabricated by discretely forming the face 2 and the other part (body) followed by welding these parts together. The face 2 was forged from DAT55G commercially available from Daido Steel Co., Ltd., whereas the body was forged from 6Al-4V titanium. The head had a volume of 450 cc. A golf club was fabricated by assembling the resultant head with a carbon shaft and a grip. The golf club had a club balance of D1 (14-inch type).

In Example 1, the mean sole thickness was 1.2 mm, whereas each of the distances d1 and d2 was 5.0 mm. In Example 1, T7 was the greatest of the gaps T1 to T8, whereas H6 was the greatest of the gaps H1 to H8.

Example 2

A head of Example 2 was fabricated the same way as in Example 1, except that the distance d1 was 4.0 mm and the distance d2 was 2.5 mm.

Example 3

A head of Example 3 was fabricated the same way as in Example 1, except that the distance d1 was 9.0 mm and the distance d2 was 7.0 mm, and that T6 was the greatest of the gaps T1 to T8.

Comparative Example 1

A head of Comparative Example 1 was fabricated the same way as in Example 1, except that the distance d1 was 3.2 mm and the distance d2 was 1.0 mm, and that T5 was the greatest of the gaps T1 to T8, whereas H7 was the greatest of the gaps H1 to H8.

Comparative Example 2

A head of Comparative Example 2 was fabricated the same way as in Example 1, except that the distance d1 was 11.0 mm and the distance d2 was 9.0 mm, and that T6 was the greatest of the gaps T1 to T8 whereas H5 was the greatest of the gaps H1 to H8.

In Examples 1 to 3 and Comparative Examples 1 and 2, the above specifications such as the distances d1 and d2 were varied by adjusting the depths or locations of the toe-side recess 5*t* and the heel-side recess 5*h*.

Figure 8:
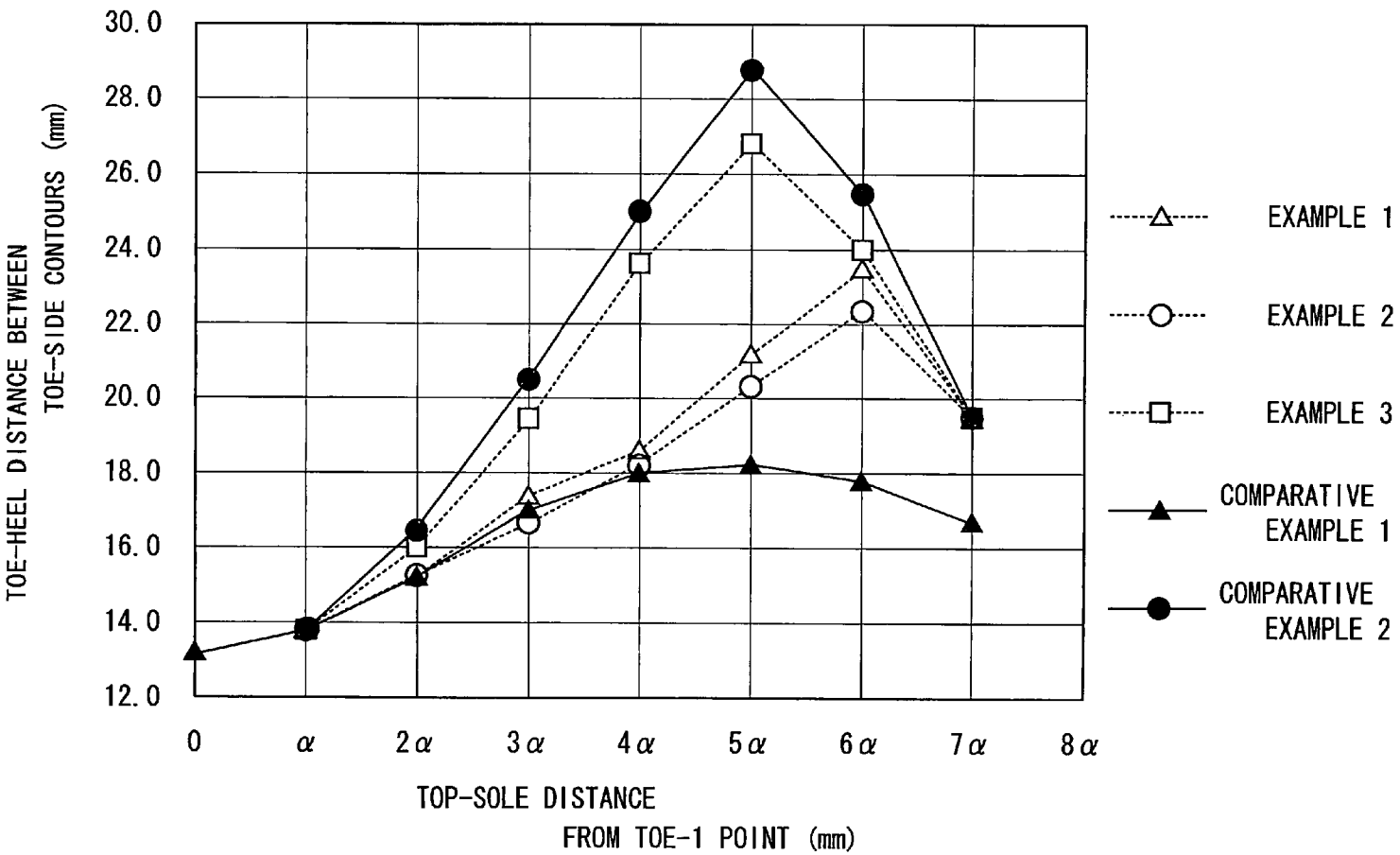
FIG. 8 shows a toe-side graph of Examples 1 to 3 and Comparative Examples 1, 2.
Figure 9:
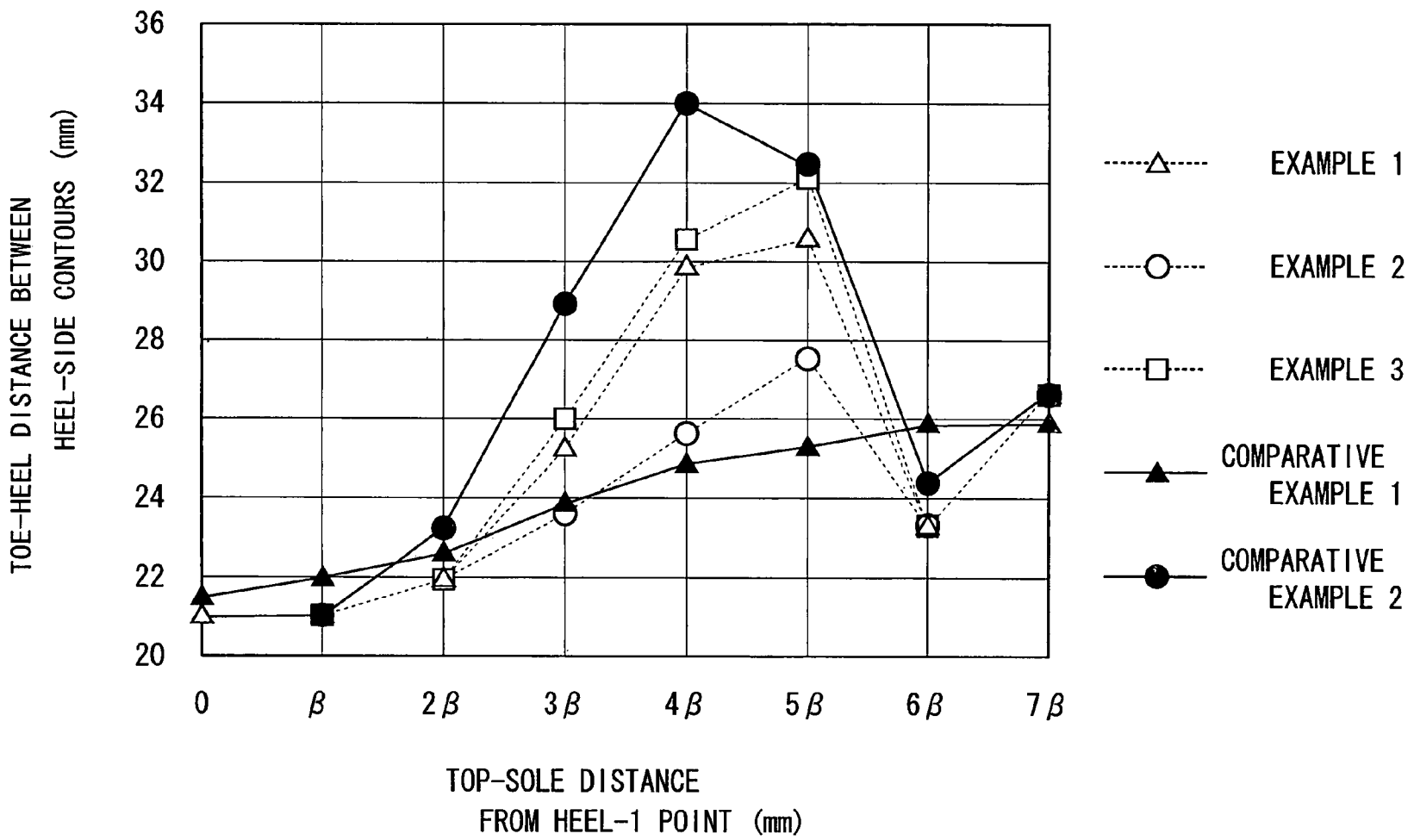
FIG. 9 shows a heel-side graph of Examples 1 to 3and Comparative Example 1, 2.

An overlap view of Comparative Example 1 is shown in FIG. 4. Toe-side graphs of Examples 1 to 3 and Comparative Examples 1 and 2 are shown in FIG. 8, whereas heel-side graphs of Examples 1 to 3 and Comparative Examples 1 and 2 are shown in FIG. 9.

The evaluation results of the golf clubs of the individual examples are listed in Table 1 as below.

TABLE 1

| | Ex. 1 | Ex. 2 | Ex. 3 | C. Ex. 1 | C. Ex. 2 |
|---|---|---|---|---|---|
| MEAN THICKNESS OF SOLE (mm) | 1.2 | 1.2 | 1.2 | 1.2 | 1.2 |
| DISTANCE d1 (mm) | 5.0 | 4.0 | 9.0 | 3.2 | 11.0 |
| GREATEST OF T1 T0 T8 | T7 | T7 | T6 | T5 | T6 |
| DISTANCE d2 (mm) | 5.0 | 2.5 | 7.0 | 1.0 | 9.0 |
| GREATEST OF H1 T0 H8 | H6 | H6 | H6 | H7 | H5 |
| MAXIMUM FREQUENCY (Hz) | 6300 | 5000 | 6300 | 3150 | 6300 |
| SOUND PRESSURE (OVERALL VALUE) (dba) | 120 | 123 | 118 | 130 | 118 |
| SENSORY EVALUATION SCORE | 4.7 | 4.3 | 4.8 | 2.5 | 4.8 |
| PRODUCTIVITY | ○ | ○ | Δ | ○ | X |

An evaluation method for the examples is described.

In each example, a swing robot with an impact point adjusted to the face center was used to strike a teed-up ball, while measurement was taken on the impact sound. The individual examples used common balls and set a head speed to 40 m/s. The impact sounds of the individual examples were measured under the same conditions and according to the following method. The impact sound was recorded through a microphone set at place 30 cm toward the toe side from the tee. The recorded impact sound was Fourier transformed by means of an FFT analyzer and was subjected to A-filter process and ⅓ octave band process. Thus, the maximum peak frequency and the sound pressure (overall value) were calculated. These results are listed in Table 1.

Apart from the test using the swing robot, the following sensory evaluation test was conducted as follows. Ten golfers handicapped at 5 to 15 were each asked to strike balls outdoors (at a tee ground of a golf course) using golf clubs assembled with the respective heads of the examples. The golfers evaluated the comfortableness of the impact sounds on a one-to-five scale (the higher score indicating the better evaluation). A mean value of the scores given by the ten golfers was calculated and is shown in the column of "SENSORY EVELUATION SCORE" of Table 1.

The respective heads of the examples were evaluated for the productivity in the manufacture process on a one-to-three scale. A head taking the shorter surface polishing time is evaluated the better. The evaluation results are indicated by ○, Δ and x in the descending order.

As shown in Table 1, the club heads of Examples 1to 3 were more excellent than that of Comparative Example 1 in the comprehensive evaluation of the maximum peak frequency and the sound pressure (overall value). That is, the club heads of the examples achieved higher scores than that of the comparative example in the sensory evaluation. The club head of Comparative Example 1 had a lower score in the sensory evaluation because the impact sound had the excessively large volume and the excessively low frequency. On the other hand, the club head of Comparative Example 2 had relatively greater depths at the toe-side recess and the heel-side recess, so that a normal buffing machine was unable to fully buff the overall inside surface of the recess, which was polished by using a manual polishing operation in combination with the buffing machine. Accordingly, the head of Comparative Example 2 took much longer polishing time than those of the other examples, seriously decreased in productivity.

What is claimed is:

1. A golf club head, which, when placed on a horizontal plane at predetermined loft angle and lie angle and presenting a shaft-hole axis thereof in a first vertical plane perpendicular to the horizontal plane, has a surface contour defined by differences in the contour of a cross-section of the club head lying in a fourth vertical plane superimposed on the contour of a cross-section of the club head lying in a second vertical plane, and wherein the second and fourth vertical planes are parallel to the first vertical plane and spaced rearwardly from the first vertical plane in a direction toward a rearmost point of the club head that is farthest from the first vertical plane;

a plane, parallel to the first vertical plane and including the rearmost point, is defined as a fifth vertical plane;

three planes parallel to the first vertical plane and equally dividing space between the first vertical plane and the fifth vertical plane into quarters are defined as the second vertical plane, a third vertical plane and the fourth vertical plane in this order in a direction rearwardly from the first vertical plane;

a second contour is defined by the perimeter of the cross-section lying in the second vertical plane, and a fourth contour is defined by the perimeter of the cross-section lying in the fourth vertical plane;

a point on a toe-side of the fourth contour that is closest to a toe of the club head is defined as a toe-1 point, and a point on the toe-side of the fourth contour that is closest to a sole of the club head is defined as a sole-lowest point;

seven points dividing the toe-side of the fourth contour at equally spaced levels in a top-sole direction are defined as toe-2 point, toe-3 point, toe-4 point, toe-5 point, toe-6 point, toe-7 point and toe-8 point in this order starting from the toe-1 point;

a toe-heel distance from the toe-1 point to a point on the second contour at the same level is defined as T1, a toe-heel distance from the toe-2 point to a point on the second contour at the same level is defined as T2, a toe-heel distance from the toe-3 point to a point on the second contour at the same level is defined as T3, a toe-heel distance from the toe-4 point to a point on the second contour at the same level is defined as T4, a toe-heel distance from the toe-5 point to a point on the second contour at the same level is defined as T5, a toe-heel distance from the toe-6 point to a point on the second contour at the same level is defined as T6, a toe-heel distance from the toe-7 point to a point on the second contour at the same level is defined as T7, a toe-heel distance from the toe-8 point to a point on the second contour at the same level is defined as T8;

one of T5, T6 and T7 is the greatest of the distances T1 to T8; and in a graph plotting eight coordinate values of the toe-1 point to the toe-8 point (0, T1), ($\alpha$, T2), (2$\alpha$, T3), (3$\alpha$, T4), (4$\alpha$, T5), (5$\alpha$, T6), (6$\alpha$, T7), (7$\alpha$, T8) ($\alpha$ represents a positive constant) on orthogonal coordinates having top-sole distance (mm) from the toe-1 point on the abscissa and the toe-heel distance (mm) on the ordinate, the greatest ordinate-axis distance between the graph and a straight line connecting the plot (0, T1) of the toe-1 point and the plot (7$\alpha$, T8) of the toe-8 point is in the range of 4 mm or more and 10 mm or less.

2. A golf club comprising the golf club head according to claim 1, a shaft having one end insertedly bonded to a shaft hole of the golf club head, and a grip assembled to the other end of the shaft.

3. A golf club head, which, when placed on a horizontal plane at predetermined loft angle and lie angle and presenting a shaft-hole axis thereof in a first vertical plane perpendicular to the horizontal plane, has a surface contour defined by differences in the contour of a cross-section of the club head lying in a fourth vertical plane superimposed on the contour of a cross-section of the club head lying in a second vertical plane, and wherein the second and fourth vertical planes are parallel to the first vertical plane and spaced rearwardly from the first vertical plane in a direction toward a rearmost point of the club head that is farthest from the first vertical plane;

a plane, parallel to the first vertical plane and including the rearmost point, is defined as a fifth vertical plane;

three planes parallel to the first vertical plane and equally dividing space between the first vertical plane and the fifth vertical plane into quarters are defined as the second vertical plane, a third vertical plane and the fourth vertical plane in this order in a direction rearwardly from the first vertical plane;

a second contour is defined by the perimeter of the cross-section lying in the second vertical plane, and a fourth contour is defined by the perimeter of the cross-section lying in the fourth vertical plane;

a point on a heel-side of the fourth contour that is closest to a heel of the club head is defined as a heel-1 point, and a point on the heel-side of the fourth contour that is closest to a sole of the club head is defined as a sole-lowest point;

seven points dividing the heel-side of the fourth contour at equally spaced levels in a top-sole direction are defined as heel-2 point, heel-3 point, heel-4 point, heel-5 point, heel-6 point, heel-7 point and heel-8 point in this order starting from the heel-1 point;

a toe-heel distance from the heel-1 point to a point on the second contour at the same level is defined as H1, a toe-heel distance from the heel-2 point to a point on the second contour at the same level is defined as H2, a toe-heel distance from the heel-3 point to a point on the second contour at the same level is defined as H3, a toe-heel distance from the heel-4 point to a point on the second contour at the same level is defined as H4, a toe-heel distance from the heel-5 point to a point on the second contour at the same level is defined as H5 a toe-heel distance from the heel-6 point to a point on the second contour at the same level is defined as H6, a toe-heel distance from the heel-7 point to a point on the second contour at the same level is defined as H7, a toe-heel distance from the heel-8 point to a point on the second contour at the same level is defined as H8;

one of H5, H6 and H7 is the greatest of the distances H1 to H8; and in a graph plotting eight coordinate values of the heel-1 point to the heel-8 point (0, H1), ($\beta$, H2), (2$\beta$, H3), (3$\beta$, H4), (4$\beta$, H5), (5$\beta$, H6), (6$\beta$, H7), (7$\beta$, H8) ($\beta$ represents a positive constant) on orthogonal coordinates having top-sole distance (mm) from the heel-1 point on the abscissa and the toe-heel distance (mm) on the ordinate, the greatest ordinate-axis distance between the graph and a straight line connecting the plot (0, H1) of the heel-1 point and the plot (7$\beta$, H8) of the heel-8 point is in the range of 2 mm or more and 8 mm or less.

4. A golf club comprising the golf club head according to claim 3, a shaft having one end insertedly bonded to a shaft hole of the golf club head, and a grip assembled to the other end of the shaft.

5. A golf club head according to claim 1, wherein a point on a heel-side of the fourth contour that is closest to a heel of the club head is defined as a heel-1 point, and a point on the heel-side of the fourth contour that is closest to a sole of the club head is defined as a sole-lowest point;

seven points dividing the heel-side of the fourth contour at equally spaced levels in a top-sole direction are defined as heel-2 point, heel-3 point, heel-4 point, heel-5 point, heel-6 point, heel-7 point and heel-8 point in this order starting from the heel-1 point;

a toe-heel distance from the heel-1 point to a point on the second contour at the same level is defined as H1, a toe-heel distance from the heel-2 point to a point on the second contour at the same level is defined as H2, a toe-heel distance from the heel-3 point to a point on the second contour at the same level is defined as H3, a toe-heel distance from the heel-4 point to a point on the second contour at the same level is defined as H4, a toe-heel distance from the heel-5 point to a point on the second contour at the same level is defined as H5, a toe-heel distance from the heel-6 point to a point on the second contour at the same level is defined as H6, a toe-heel distance from the heel-7 point to a point on the second contour at the same level is defined as H7, a toe-heel distance from the heel-8 point to a point on the second contour at the same level is defined as H8;

one of H5, H6 and H7 is the greatest of the distances H1 to H8; and in a graph plotting eight coordinate values of the heel-1 point to the heel-8 point (0, H1), (β, H2), (2β, H3), (3β, H4), (4β, H5), (5β, H6), (6β, H7), (7β, H8) (β represents a positive constant) on orthogonal coordinates having top-sole distance (mm) from the heel-1 point on the abscissa and the toe-heel distance (mm) on the ordinate, the greatest ordinate-axis distance between the graph and a straight line connecting the plot (0, H1) of the heel-1 point and the plot (7β, H8) of the heel-8 point is in the range of 2 mm or more and 8 mm or less.

6. A golf club comprising the golf club head according to claim 5, a shaft having one end insertedly bonded to a shaft hole of the golf club head, and a grip assembled to the other end of the shaft.

* * * * *